US005083785A

United States Patent [19]

Okada

[11] Patent Number: 5,083,785

[45] Date of Patent: Jan. 28, 1992

[54] WIN CONTROL METHOD AND APPARATUS FOR GAME MACHINES

[75] Inventor: Kazuo Okada, Tokyo, Japan

[73] Assignee: Kabushiki Kaisha Universal, Tokyo, Japan

[21] Appl. No.: 573,477

[22] Filed: Aug. 27, 1990

[30] Foreign Application Priority Data

Aug. 30, 1989 [JP] Japan ..... 1-224074

[51] Int. Cl.[5] ..... G07F 17/34; A63B 71/00; A63F 9/24

[52] U.S. Cl. ..... 273/143 R; 273/138 A

[58] Field of Search ..... 273/143 R, 138 A; 364/412

[56] References Cited

U.S. PATENT DOCUMENTS

| | | | |
|---|---|---|---|
| 4,669,731 | 6/1987 | Clarke | 273/138 A |
| 4,817,951 | 4/1989 | Crouch et al. | 273/138 A |
| 4,864,499 | 9/1989 | Casey | 273/138 A |

*Primary Examiner*—Edward M. Coven
*Assistant Examiner*—Jessica J. Harrison
*Attorney, Agent, or Firm*—Young & Thompson

[57] ABSTRACT

A game machine has a win judgment table. The table stores win information corresponding to each integer in a range of integers. An integers assigned to one special win paying the largest prize is located at the end of the range of integers. In the first game of a win cycle, one integer is randomly selected from the range of integers, and the win information corresponding to this integer is used to determine the outcome of the first game. In each subsequent game of said win cycle, the integer used to determine the outcome of the previous game is incremented and the resulting integer used for the current game. When the end of the integer range is reached, the special win occurs, and the next game becomes the first game of a new win cycle. It is thus assured that the special win occurs in each cycle of games, and that the number of games between special wins never exceeds a certain value.

14 Claims, 4 Drawing Sheets

WIN CONTROL METHOD AND APPARATUS FOR GAME MACHINES

BACKGROUND OF THE INVENTION

The present invention relates to a win control method and apparatus for a game machine, and more particularly to a method and an apparatus capable of generating a special win with an ensured frequency.

A typical such game machine is a slot machine and the present invention will be described and illustrated by way of example in connection with a slot machine; but it is to be understood that the invention is applicable to other game machines as well.

Slot machines are so designed that, when a start lever is operated after a coin or coins have been inserted, a plurality of reels, for example three reels, are rotated simultaneously. After the reels have reached a steady angular velocity, the reels can be controlled to stop. In a manually stopped type of machine, the reels are separately stopped by operating corresponding stop buttons. In an automatically stopped type of machine, the reels are stopped one after another by an automatic stop mechanism. If the symbol combination consisting of three symbols arranged on a prize-winning line after the reels have stopped is a winning symbol combination, a prize corresponding to the rank of that particular win is awarded to the player. Among the winning symbol combinations, a combination e.g. of triple "7", i.e., 7-7-7 is the special win, in other words, the so-called big win or big hit, and the most valuable prize is awarded to the player for it. Taking into consideration the paying ratio, win control is performed according to probabilities, so that the big win occurs only once in one cycle of games (for example, a cycle constituted by 4096 games).

In order to control winning, a table (win judgment table) is provided for indicating whether or not there is to be a win with respect to each random number and if so, the rank of that win. Sampling is carried out for each game and a judgment as to whether there is to be a win among the sampled random numbers is made with reference to the win judgment table. Therefore, although the big win should occur once during one cycle of games in terms of probabilities, it is in fact possible that no big win might occur during several cycles. If this should occur, the players' enthusiasm or interest in the game would be lost.

There is also a video type of slot machine, in which reels are simulated so as to display rows of symbols on a CRT. The above problem is the same in this type of machine; and so the present invention is equally applicable to both slot machines with reels and slot machines with a CRT display.

OBJECT OF THE INVENTION

The object of the present invention is to provide a win control method and apparatus for a game machine, in which a special win necessarily occurs in one cycle of games.

SUMMARY OF THE INVENTION

To achieve the above and other objects and advantages, the present invention provides a win judgment table in which a special win is allotted or assigned to a numerical value at the end of a series of numerical values or to a numerical value in the vicinity thereof. A numerical value included in the series of numerical values is sampled at random only for the first game, and a win judgment is made based on such sampled numerical value in the first game. The game is controlled in accordance with the result of this judgment. In a second game and in the games thereafter, the sampled numerical value is used as an initial numerical value and the win judgment is made using a numerical value (prearranged or predetermined numerical value) specified by the number of times the game has been played. This prearranged numerical value varies in such a manner as to be shifted toward the end of the series of numerical values including the numerical value of the special win. When the prearranged numerical value has reached the end of the series of numerical values as a result of a large number of games having been played, one cycle of games is over. The next game is the first game of the next cycle and numerical values are sampled at random again.

In a preferred embodiment of the present invention, the series of numerical values is a series of integers including the minimum numerical value M and the maximum numerical value N, and the special win is assigned to the maximum numerical value N. In a second game and in games thereafter, such sampled numerical value is used as an initial numerical value, and numerical values which have been shifted one by one toward the maximum numerical value N become the prearranged numerical values for such games.

According to the present invention, sine all numerical values included in the full range of the series of numerical values are used for the win control, a special win will occur in one game cycle without fail.

BRIEF DESCRIPTION OF THE DRAWINGS

The features and advantages of the present invention will become more apparent from the detailed description of the invention that follows, with reference to the accompanying drawings, wherein.

DETAILED DESCRIPTION OF THE INVENTION

Figure 1:
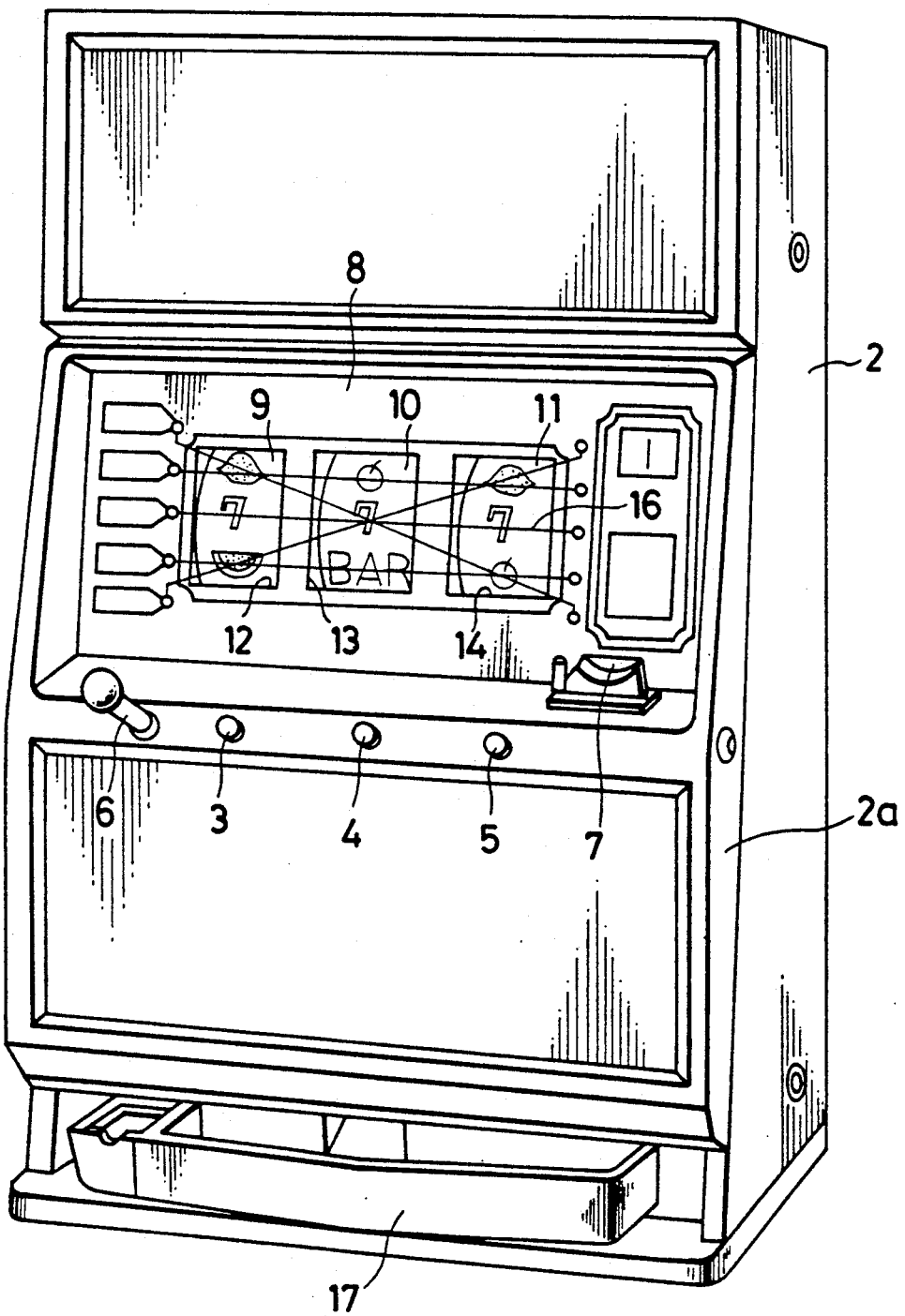
FIG. 1 is a front perspective view of a slot machine embodying the present invention.

In FIG. 1, which shows a slot machine of the present invention, the slot machine 2 is provided with a front door 2a which can be opened and closed with respect to a main body of the slot machine 2. This front door 2a is provided with stop buttons 3 to 5, a start lever 6, and a coin insertion slot 7. A front panel 8 is mounted on an upper part of the door 2a, above stop buttons 3 to 5, and a first reel 9, a second reel 10 and a third reel 11 are rotatably disposed on a rear side of the front pane 18. Each reel 9 to 11 bears on its outer periphery various symbols such as, for example, "lemon", "7" and "watermelon". These symbols can be observed through three windows 12 to 14 formed in the front panel 8. A plurality of prize-winning lines 16 traverse the respective windows 12 to 14, and the number of the effective lines is increased when a greater number of coins is inserted.

When the start lever 6 is actuated after a coin or coins have been inserted into the coin insertion slot 7, the respective reels 9 to 11 are simultaneously made to start rotating, and the stop buttons 3 to 5 can be actuated after the reels have reached a steady speed of rotation. When the stop buttons 3 to 5 are actuated at a desired time interval, stop control is initiated and the respective reels 9 to 11 are stopped, whereupon a predetermined symbol combination is displayed on the effective prize-winning line 16. But if the symbol combination that stops on the effective prize-winning line 16 is a prize-winning symbol combination, the number of coins corresponding to the prize-winning rank of that combination are paid out into a coin saucer 17. In case no buttons have been actuated within a predetermined period of time, the respective reels 9 are sequentially stopped by an automatic stop mechanism known per se.

Figure 2:
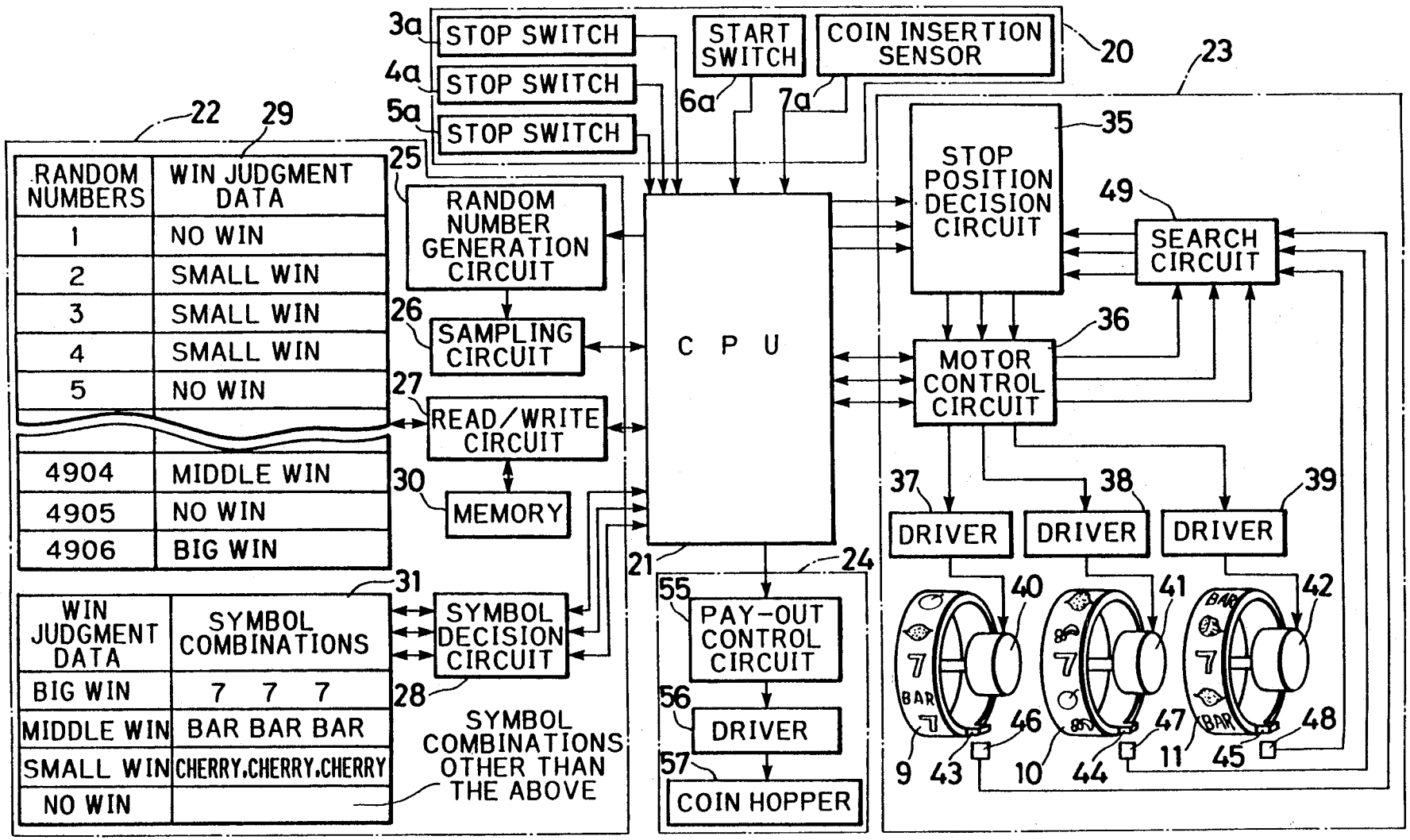
FIG. 2 is a schematic view showing an electrical circuit incorporated in the slot machine of FIG. 1.

In FIG. 2, it will be seen that the electrical circuit of the slot machine 2 comprises blocks representing elements of an operating portion 20, a central processing unit (hereinafter simply referred to as the CPU) 21, a symbol judgment portion 22, a stop control portion 23, and a coin pay-out portion 24.

The operating portion 20 comprises stop switches 3*a* to 5*a* which are turned on by the corresponding stop buttons 3 to 5, a start switch 6*a* which is turned on by the start lever 6, and a coin sensor 7*a* which is turned on by a coin or coins that are inserted, all of 3*a*–7*a* being separately connected to the CPU 21.

The symbol judgment portion 22 has a random number generation circuit 25, a sampling circuit 26, a read/-write circuit 27, a symbol decision circuit 28, a win judgment table 29, a memory 30 and a symbol combination table 31 which are all connected in the CPU 21. These tables 29 and 31 comprise a ROM. Upon receipt of a coin detection signal from the coin sensor 7*a*, the CPU 21 sends a random number generation signal to the random number generation circuit 25 to generate at random numerical values included in a series of integers ranging from 1" to "4096". Thereafter, when a start signal from the start switch 6*a* is input into the CPU 21, the CPU 21 sends a sampling signal to the sampling circuit 26 for the first game within one cycle in order to cause the sampling circuit 26 to sample one numerical value among the random numbers periodically generated by the random number generation circuit 25. When this sampling is finished, or when the CPU 21 judges that there is in progress a second game or subsequent game, this CPU 21 stops the random number generating circuit 25.

The read/write circuit 27 reads win judgment data (data indicating whether there is a win or not as well as data indicating the rank thereof) stored in the win judgment table 29 based on a numerical value N stored in the memory 30. This numerical value N is a random number or a prearranged numerical value determined on the basis of the random number. The win judgment table 29 shows the relation between the win judgment data and each numerical value constituting a series of numerical values ranging from the minimum numerical value "1" to the maximum numerical value "4096", and the respective numerical values are used as addresses. In this embodiment, although the big win is assigned to the numerical value "4096", the big win may be assigned to "1" as a numerical value at the other end of the series of numerical values. Furthermore, the big win may be assigned to a numerical value in the vicinity either of "4096" or of "1", for example, "4095" or "2". When win judgment data are sent from the CPU 21 to the symbol decision circuit 28, the symbol decision circuit 28 reads a combination of symbols corresponding to the win judgment data from the symbol table 31 and sends them to the CPU 21 after splitting the same into three symbol signals corresponding to the respective reels 9 to 11.

The stop control portion 23 comprises a stop position decision circuit 35, a motor control circuit 36, drivers 37 to 39, pulse motors 40 to 42 for driving the respective reels 9 to 11, photosensors 46 to 48, and a search circuit 49. The photosensors 46 to 48 are adapted to detect the passage of light shielding element 43 to 45 formed on the respective reels 9 to 11 so as to determine reference positions for the respective reels 9 to 11.

The motor control circuit 36 is adapted to control the driving of the respective pulse motors 40 to 42, and to send driving pulses, which have been fed to the respective pulse motors 40 to 42, to the search circuit 49. The search circuit 49 is adapted to start counting the driving pulses when detection signals are generated from the photosensors 46 to 48 so as to determine the number of driving pulses corresponding to the rotated positions of the respective reels 9 to 11. The search circuit 49, as is known, has a symbol combination table representing the relation between the driving pulses and symbol combinations which are borne by the reels and is adapted to determine the positions of the respective symbols on the rotating reels 9 to 11 from the number of the counted driving pulses. When a stop signal is input from the CPU 21, the stop position decision circuit 35 receives information on the predetermined positions of the respective symbols on the reels 9 to 11 from the search circuit 49, and outputs stop position signals for the respective reels to the motor control circuit 36, so that these symbols will be stopped on the effective prize-winning line 16.

If the time when the stop buttons 3 to 5 are operated is markedly different from the time when the respective reels 9 to 11 are actually stopped, the player might be given an undesirable impression. Therefore, the stopping times are set in a range which will not give such an impression to the player. For example, they are set such that the respective pulse motors 40 to 42 are stopped before the symbols on the respective reels 9 to 11 are moved by more than a few symbols from the time the stop signal is output. Therefore, the combination of symbols decided by the symbol decision circuit 28 is not necessarily accomplished. In case the combination of symbols is, in particular, a big win of a combination of 7-7-7, the request for this big win is carried over to the next game.

A coin pay-out section 24 comprises a pay-out control circuit 55 connected to the CPU 21, and a coin hopper 57 connected to the coin pay-out control circuit 55 through a driver 56. If the combination of symbols is a winning symbol combination after the pulse motors 40 to 42 are all stopped, the pay-out control circuit 55 causes the coin hopper 57 to pay out coins corresponding to the rank of the winning symbol combination.

Figure 3:
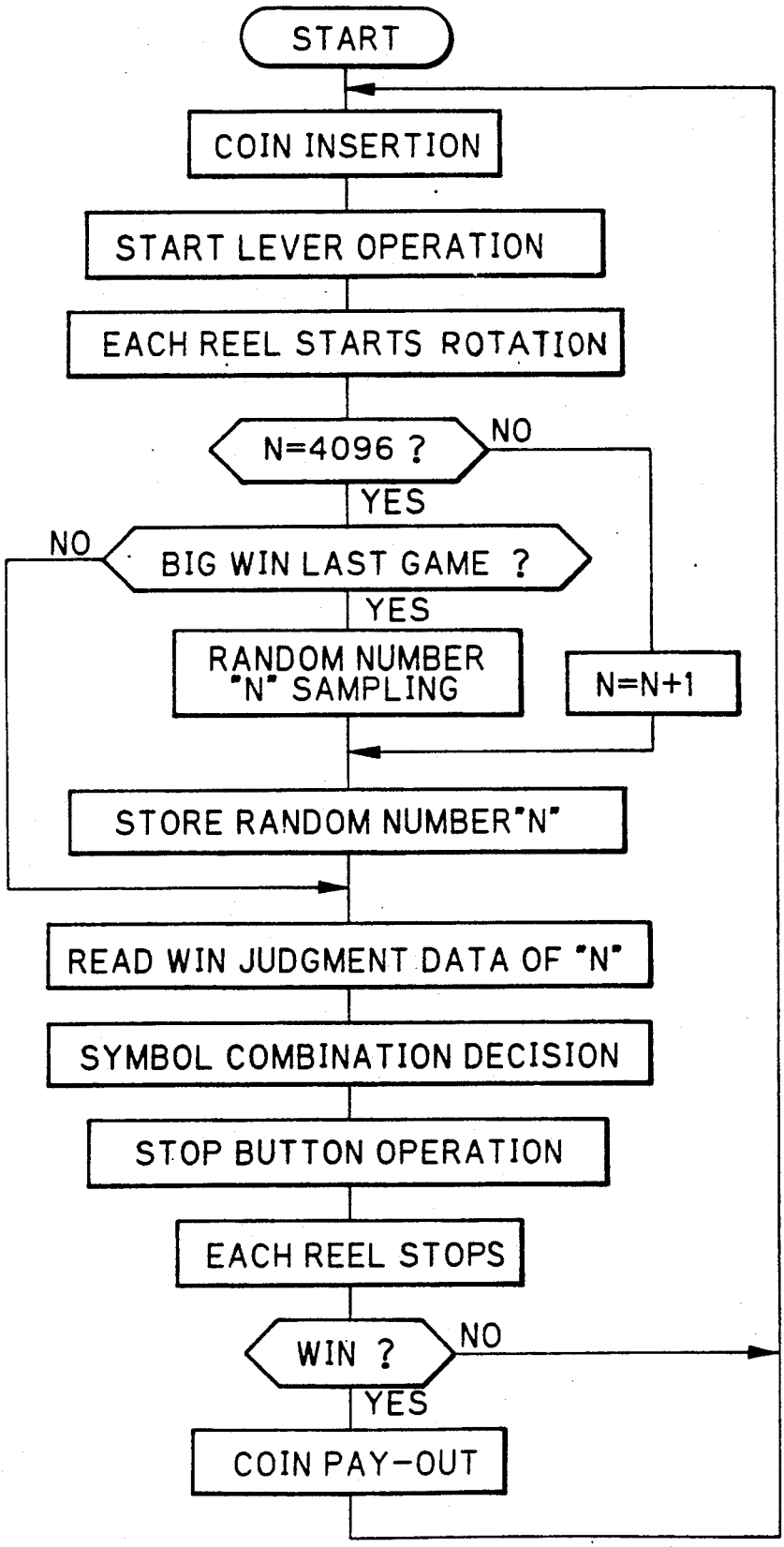
FIG. 3 is a flow chart showing the events of a game played with the slot machine of this invention.
Figure 4:
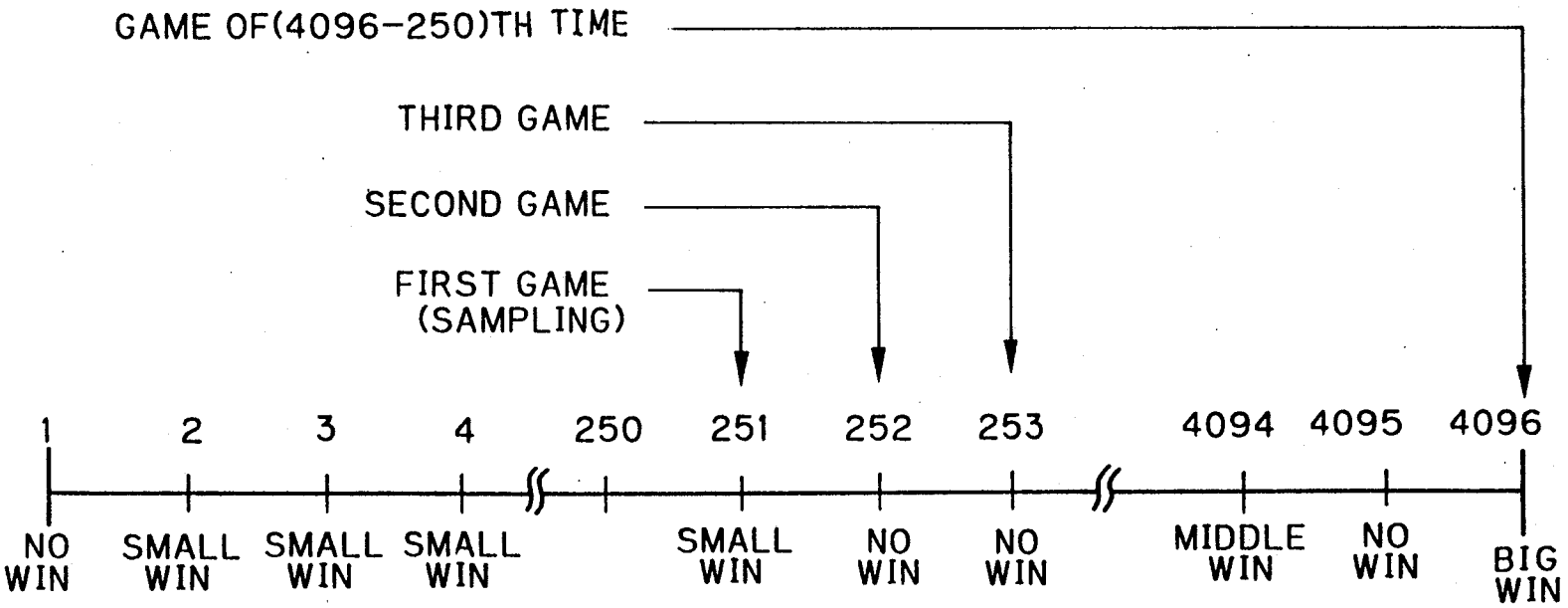
FIG. 4 is an explanatory view showing the relation between the number of games played and the prearranged numerical value.

The operation of the above embodiment will now be described with reference to FIGS. 3 and 4. When a coin or coins have been inserted into the coin insertion slot 7, the CPU 21 actuates the random number generation circuit 25. Then, upon actuation of the start lever 6, the CPU 21 instructs the motor control circuit 36 to start the pulse motors 40 to 42. At the same time, the CPU 21 judges whether the game is a first game with reference to the numerical value "N" stored in the memory 30. In case the numerical value "4096" is stored in the memory 30, the CPU 21 judges it as a first game, and instructs the sampling circuit 26 to sample one number from among random numbers which belong to the series of numerical values ranging from "1" to "4096".

This sampled random number is then stored in the memory 30 as a numerical value "N". If the numerical value N happens to be, say, "251", as shown by way of example in FIG. 4, the CPU 21 accesses the win judgment table 29 through the read/write circuit 27 and reads win judgment data of a small win corresponding to the numerical value "251". Thereafter, the CPU 21 selects three symbols "cherry", "cherry" and "cherry" corresponding to a prize-winning combination comprising a small win, from the symbol table 31 through the symbol decision circuit 28, and sends these symbol signals to the stop position decision circuit 35.

When the respective pulse motors 40 to 42 have reached a steady speed of rotation, it becomes possible to actuate the stop buttons 3 to 5. Thereafter, the respective stop buttons 3 to 5 are actuated, and a stop signal is sent from the CPU 21 to the stop position decision circuit 35. The stop position decision circuit 35 determines a stop position signal for each pulse motor for stopping the symbol "cherry" on the prize-winning line with reference to its current position as detected by the search circuit 49. The motor control circuit 36 stops the pulse motors in accordance with the stop position signals and aligns the symbols "cherry" on the respective reels on the effective prize-winning line 16. When the reels 9 to 11 are all stopped, a combination of symbols "cherry", "cherry" and "cherry" is displayed on the effective prize-winning line 16. In case the stop buttons 3 to 5 are not actuated, the motor control circuit 36 starts the stop control after a predetermined period and stops the pulse motors 40 to 42 so that the predetermined symbol combination will nevertheless be displayed. When all the reels 9 to 11 are stopped, the pay-out control circuit 55 outputs a pay-out signal to the coin hopper 57 to pay out the number of coins corresponding to the winning symbol combination "cherry", "cherry" and "cherry".

When a coin or coins are again inserted into the coin insertion slot 7 and the start lever 6 actuated in order to play a second game, the game is started in the manner previously described. In this second game, the CPU 21 reads the numerical value "251" stored in the memory 30 and then adds "1" to it. If such a sampled numerical value is used as an initial value, an obtained numerical value "252" is the prearranged numerical value which is specifically selected according to the number of times the game has been played and according to the initial value. This numerical value "252" is stored in the memory 30.

The CPU 21 reads win judgment data corresponding to the numerical value "252" from the win judgment table 29 and selects three symbols with reference to the symbol table 31. Then, when the respective stop buttons 3 to 5 are actuated, the stop control of the pulse motors 40 to 42 is effected to display the predetermined symbol combination. As this symbol combination is not a win, no coins are paid out.

The game is continued in this way. When the number of games played reaches a total of (4096–250), the numerical value N of this game becomes the maximum value "4096". Since this numerical value "4096" is a big win, the stop control of the reels 9 to 11 is executed such that a symbol combination 7-7-7 is displayed on the effective prize-winning line, provided that the timing of the operation of the stop buttons 3 to 5 is within a proper range. In this case, a large number of coins are paid out from the con hopper 57. When this big win is awarded, one cycle of games is finished. When a coin or coins are next inserted, the first game in the next cycle is started and selection of the initial numerical value is performed with random numbers as previously mentioned.

If a big win is not awarded, due to the timing of the operation of the stop buttons 3 to 5, then the numerical value "4096" is carried over to the next game. This process is continued until the big win is awarded, so that a big win will necessarily be awarded by the end of one cycle of games.

Although the prearranged numerical value in the above-described embodiment is found by successively adding "1", it may proceed toward "4096" by alternately performing addition and subtraction. For example, the prearranged numerical value may be found by adding "3" in one game and by subtracting "1" in the next game. If the big win is assigned to the minimum value "1", it may proceed to the minimum value "1" only by subtraction or by alternate subtraction and addition. Also, in the above-described embodiment, the present invention is applied to a manually stopped slot machine. However, the present invention may be likewise applied to an automatically stopped slot machine with no stop buttons, or, as mentioned, to a video type slot machine. Furthermore, instead of paying out coins each time the win occurs, there may be provided a credit counter so that obtained coins are added up and that the sum is displayed on a display device. In this case, when the start lever is actuated without inserting a coin or coins, the next game is started and, at the same time, the credit counter is subjected to subtraction processing.

It is to be understood that the present invention can be changed, altered and modified to various forms without departing from the scope of the invention.

What is claimed is:

1. A win control apparatus for a game machine, said game machine allowing repeated play of a game, said game having at least one type of winning outcome for which one of at least one type of prize is awarded, said at least one type of winning outcome including a special win for which the most valuable prize is awarded, said win control apparatus comprising:

win judgment table means for storing win information corresponding to each numerical value in an ordered, finite set of numerical values, said win information comprising the type of winning outcome, if any, corresponding to each said numerical value, a first numerical value at one end of said set corresponding to said special win;

sampling means for randomly selecting a numerical value from said set of numerical values;

numerical value shifting means for receiving a numerical value in said set of numerical values and, based on said received numerical value, selecting a different numerical value in said set closer to said one end of said set than said received numerical value;

win judgment means for determining the outcome of a game played on said game machine, said win judgment means, during a first game or during a game following a game whose outcome was said special win, using said sampling means to randomly select an initial numerical value, further using said win judgment table means to access the win information corresponding to said initial numerical value, and further providing said accessed win information as said game outcome;

said win judgment means, during any other game, using said shifting means to select a current numerical value based on the numerical value used in the previous game, further using said win judgment table means to access the win information corresponding to said current numerical value, and further providing said win information corresponding to said current numerical value as said game outcome;

means for executing a game on said game machine in accordance with said game outcome provided by said win judgment means.

2. A win control apparatus as claimed in claim 1, wherein said set of numerical values is a range of consecutive integers from "M" to "N" and said first numerical value is "M" or "N", where "M" and "N" each represent an integer such that "M"<"N".

3. A win control apparatus as claimed in claim 2, wherein said first numerical value is "N", and said numerical value shifting means increments said received numerical value by one to obtain said different numerical value.

4. A win control apparatus as claimed in claim 2, wherein said first numerical value is "M", and said numerical value shifting means decrements said received numerical value by one to obtain said different numerical value.

5. A win control apparatus as claimed in claim 2, wherein said game machine includes a non-collinear plurality of movable rows of symbols, wherein said outcome of a game played on said game machine comprises a combination of said symbols stopped on a prize-winning line transverse to said symbol rows, and wherein said game execution means controls the stopped position of each said symbol row such that a game outcome determined by said win judgment means is realized.

6. A win control apparatus for game machine as claimed in claim 5, wherein said symbol rows are borne on peripheries of respective reels, said respective reels being rotated by respective pulse motors.

7. A win control apparatus as claimed in claim 6, wherein said game machine further includes manual stop means for stopping rotation of said reels by said respective pulse motors.

8. A win control apparatus as claimed in claim 1, wherein said at least one type of winning outcome comprises a plurality of types of winning outcomes, said at least one type of prize comprises a plurality of types of prizes, each said prize comprises a quantity of coins, and said types of prizes differ from one another in said quantity.

9. A win control method for a game machine, said game machine allowing repeated play of a game, said game having at least one type of winning outcome for which one of at least one type of prize is awarded, said at least one type of winning outcome including a special win for which the most valuable prize is awarded, said win control method comprising the steps of:

storing in a win judgment table win information corresponding to each numerical value in an ordered, finite set of numerical values, said win information comprising the type of winning outcome, if any, corresponding to each said numerical value, a first numerical value at one end of said set corresponding to said special win;

determining the outcome of a game played on said game machine by selecting a numerical value from said set of numerical values, accessing from said win judgment table the win information corresponding to said selected numerical value, and using said accessed win information as said outcome, said selected numerical value, for a first game or for a game following a game whose outcome was said special win, being randomly selected from said set of numerical values, and for any other game, being selected to be closer to said one end of said set than the selected numerical value of the previous game; and executing a game played on said game machine according to said determined outcome.

10. A win control method as claimed in claim 9, wherein said game machine includes a non-collinear plurality of movable rows of symbols, wherein said outcome of a game played on said game machine comprises a combination of said symbols stopped on a prize-winning line transverse to said symbol rows, and wherein said step of executing a game comprises controlling the position of each said symbol row such that a game outcome determined by said game outcome determination step is realized.

11. A win control method as claimed in claim 10, wherein said symbol rows are borne on peripheries of respective reels, said respective reels being rotated by respective pulse motors.

12. A win control method as claimed in claim 9, wherein said set of numerical values is a range of consecutive integers from "M" to "N" and said first numerical value is "M" or "N", where "M" and "N" each represent an integer such that "M"<"N".

13. A win control method as claimed in claim 12, wherein said first numerical value is "N", and said numerical value selection for said any other game comprises incrementing said selected numerical value from the previous game by one.

14. A win control method as claimed in claim 12, wherein said first numerical value is "M", and said numerical value selection for said any other game comprises decrementing said selected numerical value from the previous game by one.

* * * * *